United States Patent [19]

Hengesbach

[11] Patent Number: 4,471,911

[45] Date of Patent: Sep. 18, 1984

[54] SPRAYING APPARATUS AND METHOD

[76] Inventor: Robert W. Hengesbach, 7886 Mentor Rd., Mentor, Ohio 44060

[21] Appl. No.; 481,278

[22] Filed: Apr. 1, 1983

Related U.S. Application Data

[63] Continuation-in-part of Ser. No. 313,456, Oct. 21, 1981, abandoned.

[51] Int. Cl.[3] ..... B05B 11/00

[52] U.S. Cl. ..... 239/327; 220/410; 222/325

[58] Field of Search ..... 239/302, 327, 328; 220/410; 222/325, 394

[56] References Cited

U.S. PATENT DOCUMENTS

| | | | |
|---|---|---|---|
| 1,145,029 | 7/1915 | Munro | 239/368 X |
| 2,072,555 | 3/1937 | Hengesbach et al. | 239/11 |
| 2,125,573 | 8/1938 | Kelley, Jr. | 239/353 |
| 2,302,799 | 11/1942 | Peterson | 137/893 X |
| 2,589,728 | 3/1952 | Pratt | 222/394 X |
| 2,659,629 | 11/1953 | Graham | 141/19 |
| 2,788,926 | 4/1957 | Morrison | 222/394 |
| 2,888,173 | 5/1959 | Wolcott | 222/325 X |
| 3,131,834 | 5/1964 | Meshberg | 22/399 |
| 3,181,737 | 5/1965 | Chaucer | 222/136 |
| 3,255,972 | 6/1966 | Hulfgren et al. | 239/328 X |
| 3,347,403 | 10/1967 | Lehrman | 220/410 |
| 3,388,838 | 6/1968 | Marchant | 222/635 |
| 3,432,104 | 3/1969 | Kalfenbach | 239/328 |
| 3,632,046 | 1/1972 | Hengesbach | 239/318 |
| 3,756,273 | 9/1973 | Hengesbach | 137/540 |

FOREIGN PATENT DOCUMENTS

| | | | |
|---|---|---|---|
| 142916 | 11/1953 | Sweden | 239/328 |

*Primary Examiner*—John J. Love
*Assistant Examiner*—Mary F. McCarthy
*Attorney, Agent, or Firm*—David A. Burge

[57] ABSTRACT

A spraying apparatus utilizes a canister which has a threaded, upwardly opening body and a threaded lid for closing the body, with the lid and body cooperating to define a chamber for receiving and clamping containers of fluid to sprayed. The containers have upwardly opening necks which carry removable caps for confining sprayable fluid during storage and transportation. When the canister lid is threaded onto the body, a fluid-containing container is compressed between the canister lid and a bottom wall of the canister body. In one embodiment, the canister lid is provided with an additional inner set of threads which receive mating threads that are formed on the neck of the container so that a seal is formed when the container neck is threaded into engagement with the canister lid. In a more preferred embodiment, a seal is formed between an upwardly facing surface of the container neck and a downwardly facing surface of the canister lid when these surfaces are clamped into engagement as the canister lid is threaded onto the canister body.

12 Claims, 6 Drawing Figures

SPRAYING APPARATUS AND METHOD

CROSS-REFERENCE TO RELATED APPLICATION

The present application is a continuation-in-part of application Ser. No. 313,456, filed Oct. 21, 1981 now abandoned, by Robert W. Hengesbach, entitled SPRAYING APPARATUS AND METHOD OF CONTROLLING RATE OF DISCHARGE OF MATERIALS THEREFROM, hereinafter referred to as the "Spraying Apparatus Case," the disclosure of which is incorporated herein by reference.

BACKGROUND OF THE INVENTION

1. Field of the Invention

The present invention relates to an improved spraying apparatus and method which utilize a canister that receives containers of fluid to be sprayed.

2. Prior Art

Many proposals have been made in efforts to provide apparatus for interchangeably spraying various types of liquids. Problems common to most spraying apparatus proposals are their inabilities to accommodate fluids of a wide range of viscosities, and their failures to provide desired degrees of discharge rate adjustability. A further problem with prior proposals has been the difficulty that is encountered in trying to switch from spraying one type of liquid to spraying another type of liquid.

Most previously proposed spraying systems require that an operator carefully clean the spraying apparatus when a change is made between liquids being sprayed. The operator must carefully clean not only internal passages of the spraying apparatus through which liquid is ducted from a canister to a nozzle for spraying, but also such interior surfaces of the canister and external surfaces of the spraying apparatus as have been exposed to the first liquid which has been sprayed. The cleaning procedures that are required to make a change from one liquid being sprayed to a different liquid are painstaking and time consuming, and result in a costly amount of undesirable "down time."

While spray regulating devices of various types have been proposed in efforts to render spraying systems adjustable so that changes can be made to accommodate sprayable liquids having different properties, and to accommodate various ambient conditions, such proposals have typically failed to provide a means by which changes can be made rapidly and efficiently between different types of liquids to be sprayed. A similar type of drawback of most prior spraying system proposals lies in the inabilities of the proposed systems to be adjusted quickly and easily to provide desired rates of discharge for use with various types of sprayable liquids.

3. The Referenced Spraying Apparatus Case

The referenced Spraying Apparatus Case addresses the need which has long existed to provide a means for permitting a spraying apparatus to be adjusted readily and easily to accommodate different types of liquids being sprayed, to adjust discharge flow rates of material being sprayed, and to accommodate changes in ambient conditions. The present invention preferably utilizes features of the methods and spraying apparatus embodiments described in the Spraying Apparatus Case to enhance the ease with which changes can be made from spraying one liquid to spraying another liquid. However, as will be apparent from the description which follows, the system of the present invention can be used with a wide variety of spraying systems including those which do not incorporate such features as form the subject matter of the Spraying Apparatus Case.

SUMMARY OF THE INVENTION

The present invention overcomes the foregoing and other drawbacks of prior proposals by providing a novel and improved spraying system which facilitates changing from spraying one liquid to spraying another, and which enables containers of different sprayable liquids to be interchangeably inserted into a canister for spraying with a minimum of apparatus clean-out and clean-up being required as a change is made between liquids to be sprayed.

A spraying apparatus embodying features of the present invention utilizes a canister which receives containers of fluid to be sprayed. The containers preferably have upwardly opening necks which carry removable caps for confining sprayable liquid during storage and transportation. The spraying apparatus is preferably provided with means for presetting or selectively controlling the rate at which materials being sprayed are discharged.

In preferred practice, the canister has a lid which takes the form of a flat, disc-like structure which has a circumferentially depending, internally threaded skirt, and an upwardly opening can-like body, rim portions of which are externally threaded. A container of liquid to be sprayed is inserted into the body of the canister, and the canister lid threaded onto the body such that the container is compressed between the canister lid and a bottom wall of the canister body. In one embodiment, the canister lid is provided with an additional inner set of threads which receive mating threads that are formed on the neck of the container so that a seal is formed when the container neck is threaded into engagement with the canister lid. In a more preferred embodiment, a seal is formed between an upwardly facing surface of the container neck and a downwardly facing surface of the canister lid when these surfaces are clamped into engagement as the canister lid is threaded onto the canister body.

A novel method of spraying liquid includes the steps of opening a canister of a spraying apparatus, inserting a container of sprayable liquid into the canister of the spraying apparatus, closing the canister whereby at least portions of the container are closely confined by portions of the outer wall of the canister, forming a seal between the neck of the container and the top wall of the canister, and operating the spraying apparatus to withdraw liquid from the container and to discharge it as a spray.

A feature of such spray apparatus as embodies the preferred practice of the present invention is that containers of a wide variety of sprayable liquids may be interchangeably positioned in a spraying canister, and such spray control adjustments as may be needed to accommodate a change in liquids being sprayed can be made quickly and easily, whereby the apparatus is especially suited to readily accommodate a wide variety of sprayable liquids.

BRIEF DESCRIPTION OF THE DRAWINGS

These and other features, and a fuller understanding of the invention may be had by referring to the following description and claims taken in conjunction with the accompanying drawings, wherein:

DESCRIPTION OF THE PREFERRED EMBODIMENT

Figure 1:
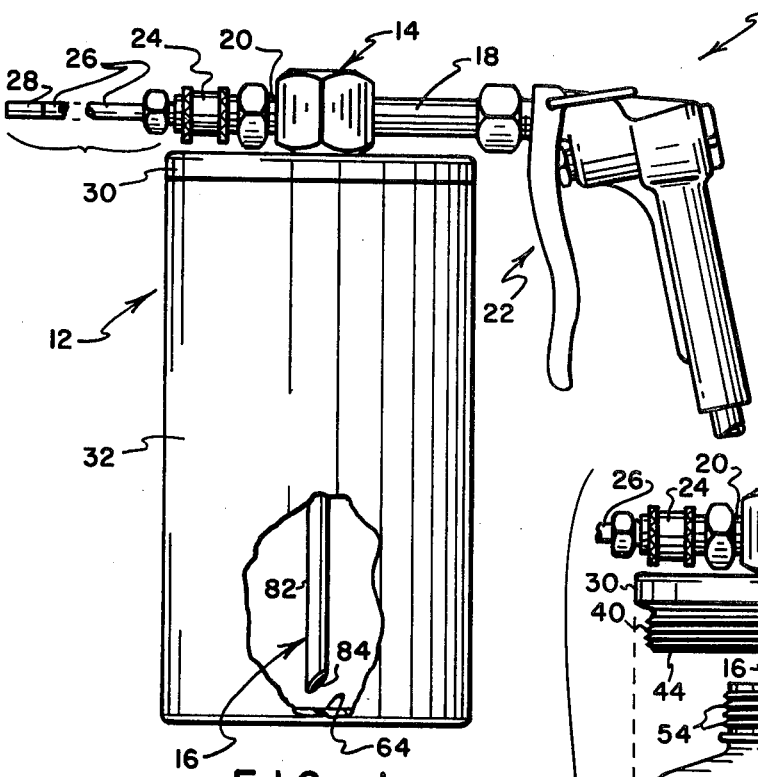
FIG. 1 is a side elevational view of a spraying apparatus which incorporates features of the present invention, with wand portions of the apparatus foreshortened, and with canister portions of the apparatus broken away to permit internal details to be viewed.
Figure 2:
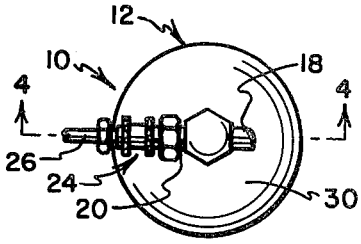
FIG. 2 is a top plan view, on a reduced scale, of portions of the apparatus of FIG. 1.
Figure 3:
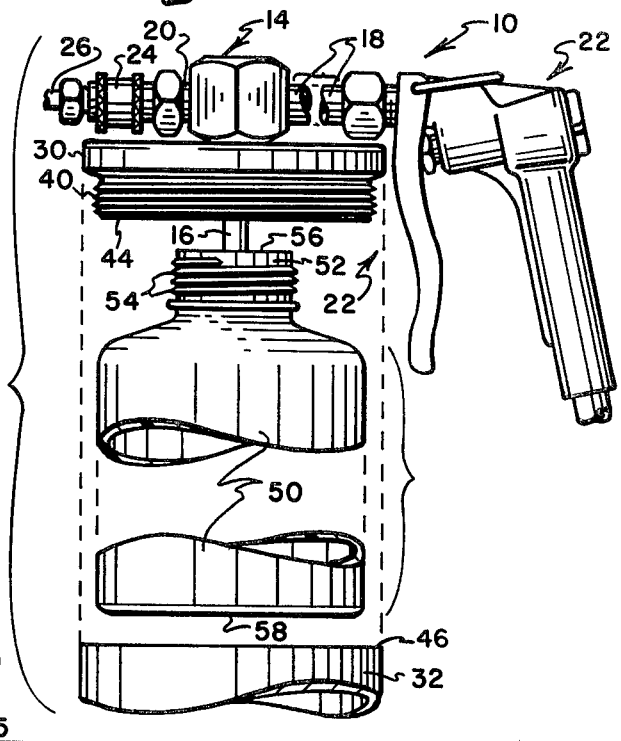
FIG. 3 is a partially exploded side elevational view showing lid and body portions of the canister separated, and showing portions of a container which is removably housed within the canister, the view having portions of an inlet conduit and portions of the container foreshortened.

Referring to FIGS 1-3, one embodiment of a spraying apparatus is indicated generally by the numeral 10. With the exception of the configuration of a canister assembly 12, the apparatus 10 is of the type described as the first of several spraying apparatus embodiments in the referenced Spraying Apparatus Case.

The apparatus 10 includes a trigger-operated valve assembly 22 which is located upstream from a spray solution reservoir vessel or canister 12. The trigger-operated valve assembly 22, is preferably of the general type described in U.S. Pat. Nos. 3,756,273, 3,632,046 and 2,072,555, the disclosures of which are also incorporated herein by reference.

By locating the control valve assembly 22 upstream from the canister assembly 12, the canister assembly 12 is caused to be pressurized by a supply of gas only when the valve assembly 22 is operated to effect spraying. An advantage of this type of arrangement is that the canister assembly 12 is maintained at ambient pressure when spraying is not in progress, whereby the canister assembly 12 can be opened for refilling without concern that its contents are pressurized. However, as is described in the referenced Spraying Apparatus Case, the control valve assembly 22 may also be located downstream from the canister assembly 12, whereby the canister assembly 12 is normally maintained in a pressurized mode. An advantage of this type of arrangement is that an immediate "instant on, instant off" spraying control is provided by the control valve assembly 22.

The spraying apparatus 10 includes a plug assembly 14 which is secured atop the upstanding pressure canister assembly 12. A tube assembly 16 depends from the plug assembly 14 into the canister assembly 12 for ducting solution from canister assembly 12 during spraying. An inlet conduit 18 and an outlet conduit 20 communicate with the plug assembly 14, as is described in the referenced Spraying Apparatus Case. The control valve assembly 22 communicates the inlet conduit 18 with a source of pressurized gas (not shown) for selectively admitting pressurized gas to the canister assembly 12. A conventional quick-disconnect coupler 24 connects one end of an elongate discharge tube or wand 26 with the outlet conduit 20. A discharge nozzle 28 is carried at the outer end of the wand 26.

All of the foregoing reference numerals correspond with those utilized to describe the first of several spraying apparatus embodiments in the referenced Spraying Apparatus Case. As will be apparent to those skilled in the art, such other spraying apparatus embodiments as are described in the referenced Spraying Apparatus Case, as well as many conventional spraying apparatus embodiments, may employ features of the present invention.

Figure 4:
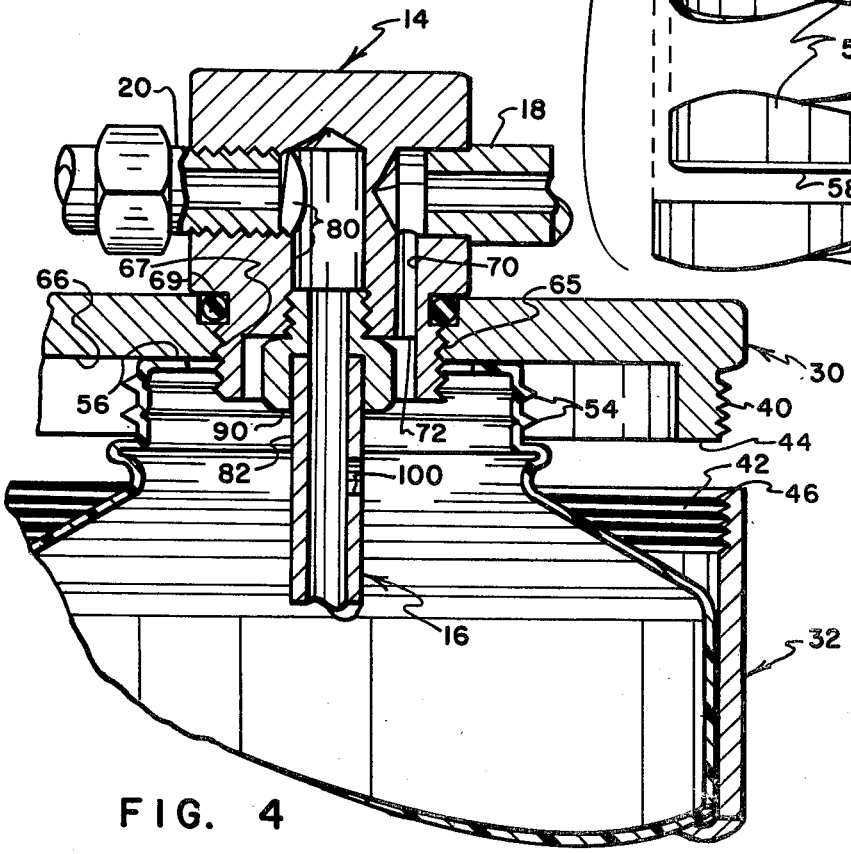
FIG. 4 is a sectional view, on an enlarged scale, of portions of the apparatus of FIGS. 1-3, as seen from a plane indicated by a line 4—4 in FIG. 2.

In a less preferred mode of operation, the the canister assembly 12 may be charged directly with liquid to be sprayed. This is done by removing a canister "closure means" in the form of a lid 30 (which carries the plug assembly 14) from a body 32 of the canister 12 to permit a sprayable liquid (not shown) to be poured directly into the body 32, whereafter the lid 30 of the canister assembly 12 is reinstalled atop the body 32. Threads 40, 42 are formed on the lid and body 30, 32, respectively, as is best seen in FIG. 4, to facilitate the formation of a pressure-tight seal between the lid and body 30, 32. The threads 40 are formed on an external surface of a depending "skirt" portion 44 of the lid 30. The threads 42 are formed internally with respect to the body 32 near a "rim" portion 46 of the body 32. If the canister assembly 12 is to be used frequently in this less preferred mode of operation, an O-ring seal (not shown) or other type of conventional seal may be provided on the body 32 to form a more secure liquid tight seal between the lid and body 30, 32, as is well known in the art. A source of pressurized gas (not shown) is connected to the control valve assembly 22 to enable spraying to begin. The canister assembly 12 remains unpressurized until the control valve assembly 22 is operated. When the control valve assembly 22 is operated, pressure within the canister assembly 12 operates to deliver liquid into the tube assembly 16, as is described in detail in the referenced Spraying Apparatus Case.

Referring to FIGS. 3 and 4, in a more preferred mode of practicing the present invention, a container 50 is provided for insertion into the canister assembly 12 to contain liquid to be sprayed (not shown). The container 50 preferably takes the form of a plastic bottle having an upwardly opening "access means" in the form of a neck 52. Threads 54 are provided on an external surface of the neck 52 to receive a conventional internally threaded cap (not shown) for closing the container 50 for storage and transport of its contents. "Formation means" in the form of a flat, upwardly facing surface 56 is provided on a rim portion of the container 50, i.e., atop the neck 52.

The canister lid 30 is provided with "formation means" in the form of a downwardly facing, substantially flat surface 66 (see FIG. 4) which is engaged by the upwardly facing flat surface 56 (see FIGS. 3 and 4) of the container neck 52. The container 50 and the canister assembly 12 are configured such that, (1) wall portions of the container 50 are closely received within corresponding wall portions of the canister assembly 12 such that the closely fitting wall portions of the canister assembly 12 serve to effectively reinforce the corresponding wall portions of the container 50, and (2) as the canister lid 30 is threaded onto the canister body 32, the "formation means" in the form of the surfaces 56, 66 are clamped together to form a seal by virtue of a bottom wall 64 (see FIG. 1) of the canister body 32 being clamped into engagement with a bottom wall 58 (see FIG. 3) of the container 50.

Referring to FIG. 4, the plug assembly 14 has an externally threaded portion 65 which is received in a threaded hole 67 formed through the lid 30. An O-ring 69 is carried on the plug assembly 14 to provide a liquid tight seal between the plug assembly 14 and the lid 30. The plug assembly 14, has an inlet passage 70, which communicates with the inlet conduit 18 and which defines an inlet opening 72 where the passage 70 opens through the bottom end region of the plug assembly 14. The inlet opening 72 is located inside the region of the container neck 52 so that pressurized gas which enters the inlet conduit 18 is delivered into the container 50.

The plug assembly 14 has an outlet passage 80 which communicates the outlet conduit 20 with the tube assembly 16. The outlet passage 80 of the apparatus 10 extends upwardly and leftwardly (as viewed in FIG. 4) for connection with the outlet conduit 20.

The tube assembly 16 includes an elongate tube 82 with a connector 90 at its upper end, and has a tapered liquid inlet opening 84 (see FIG. 1) formed at its lower end. The tube assembly 16 extends through the neck 52 of the container 50. The connector 90 threads into the outlet passage 80. One or more gas entry openings 100 are provided near the upper end of the tube assembly 16. The tube assembly 16 is shown in FIG. 4 as being provided with a single gas entry opening 100 of fixed size. However, as is described in the referenced Spraying Apparatus Case, other types of tube assemblies and the like can be substituted for the tube assembly 16 to provide means for facilitating adjustment of the effective size of such gas inlet openings as the opening 100 to enable the apparatus 10 to readily accommodate a wide variety of sprayable liquid characteristics and ambient conditions.

Figure 5:
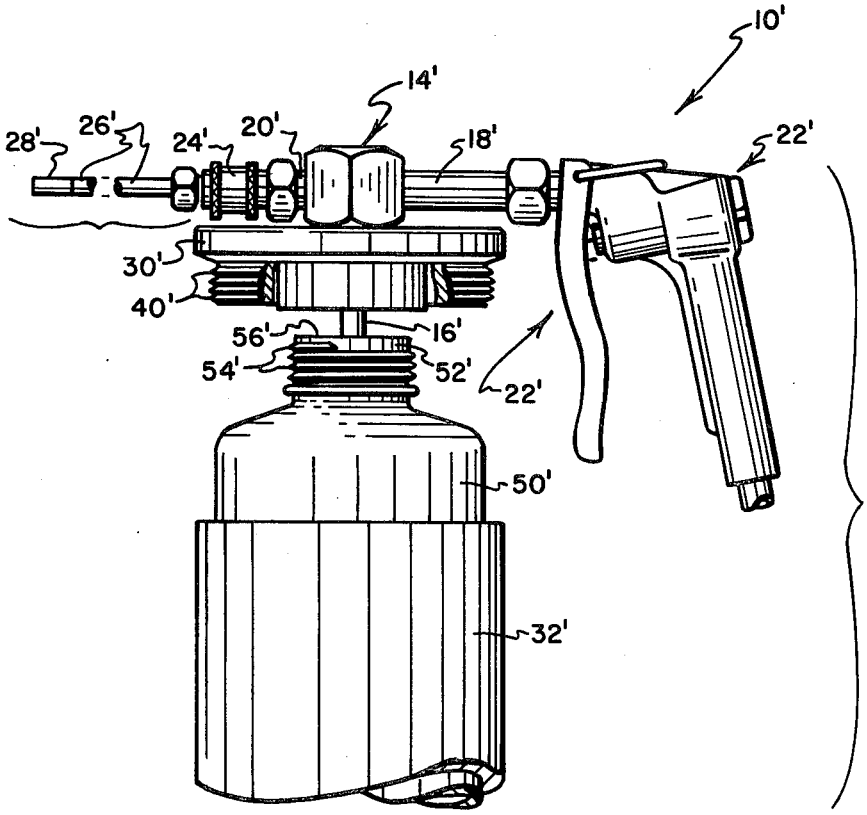
FIG. 5 is a partially exploded side elevational view similar to FIG. 3 but depicting an alternate embodiment of spraying apparatus which incorporates features of the present invention, with portions of a canister lid deleted; and, FIG. 6 is a sectional view similar to FIG. 4 but showing portions of the alternate embodiment of FIG. 5 on an enlarged scale.
Figure 6:
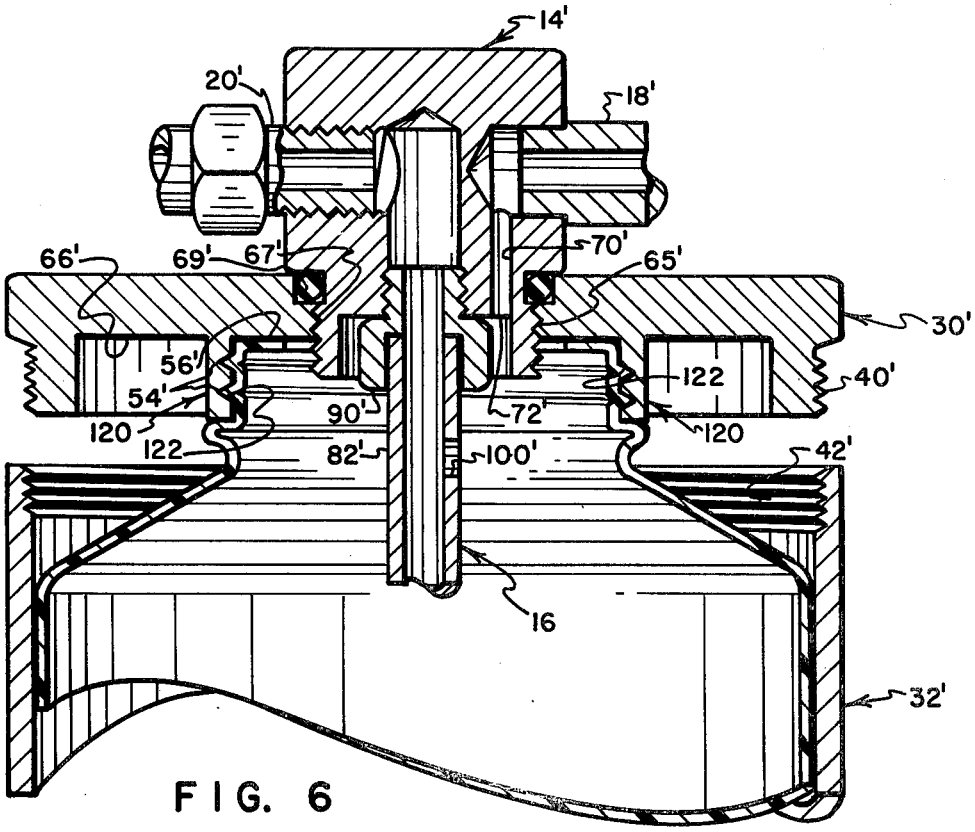

Referring to FIGS. 5 and 6, an alternate form of spraying apparatus is indicated generally by the numeral 10'. The apparatuses 10, 10' are identical in all respects with the exception that the canister lid 30' of the apparatus 10' is provided with a structure 120 which defines a formation means in the form of an inner set of threads 122 (see FIG. 6) for matingly engaging with other formation means such as threads 54' which are provided on access means in the form of a neck 52' of a liquid container 50'. Inasmuch as almost all of the elements of the apparatuses 10, 10' are identical, the majority of the elements of the apparatus 10' need not be described; instead identical elements of the apparatuses 10, 10' are indicated by corresponding numerals with such elements of the apparatus 10' as correspond with elements of the apparatus 10 being indicated by a corresponding numeral which bears a "prime" mark.

The purpose of providing the apparatus 10' with a formation means in the form of the threaded structure 120 is to enable a primary seal to be formed between the container neck 52' and the structure 120 (by virtue of the threaded engagement between "formation means" in the form of the engaging threads 54', 122) rather than to rely entirely on the establishment of seal which is formed when a "formation means" in the form of the surface 56 of the container 50 is brought into clamping engagement with formation means in the form of the surface 66 of the apparatus 10 when the canister lid and body 30, 32 respectively are threaded together to clamp the container 50.

As will be apparent from the foregoing description, a feature of the present invention lies in the provision of a novel spraying method which utilizes a canister that is configured to interchangeably receive containers of various types of sprayable liquids, whereby the liquids are confined to their containers and do not seep into the body of the canister to a degree which requires extensive cleaning of the interior of the canister when a change is made from one liquid being sprayed to another sprayable liquid. Thus, the matter of cleaning either of the apparatuses 10, 10' when a change is to be made between sprayable liquids is greatly simplified. Moreover, by utilizing the types of adjustable spray control features which are described in the referenced Spraying Apparatus Case in combination with features of the present invention, a spraying apparatus is provided which greatly facilitates changing between sprayable liquids which have different properties.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. Accordingly, it is intended that the patent shall cover, by suitable expression in the appended claims whatever features of patentable novelty exist in the invention disclosed.

What is claimed is:

1. A spraying apparatus, comprising:

(a) a bottle-like container for holding a quantity of sprayable liquid in the interior of the container, the container having a bottom wall portion, upstanding sidewall portions and a neck, and having access means in the form of a relatively wide-mouth opening defined atop the neck through which sprayable liquid may be withdrawn from the interior of the container;

(b) canister means including first and second releasably interconnectable parts for defining an openable chamber for receiving the container and for closely surrounding at least the sidewall portions of the container when the container is positioned in the chamber;

(c) formation means for establishing a seal between the access means and at least one of the canister parts in a region extending about the container opening, the formation means including:

(i) a first surface formation on an interior surface of said one of the canister parts; and, (ii) a mating surface formation on the access means of the container, which when brought into mating engagement with the first surface formation will cooperate therewith to establish a liquid-tight seal therebetween;

(d) inlet means for communicating with a source of pressurized gas, the inlet means including inlet passage means for communicating the interior of the container with a pressurized gas delivered to the inlet means, with such communication being established through the region of the container opening;

(e) means for releasably maintaining the first and mating surface formations in mating engagement for maintaining a seal between the access means and said one of the canister parts;

(f) a spray nozzle; and, (g) outlet means for ducting sprayable liquid from the interior of the container when the container is positioned in the chamber, the outlet means being operable to duct the liquid along a path of flow for discharge through the spray nozzle, with the liquid being delivered along the path of flow under the influence of pressurized gas delivered to the inlet means.

2. The spraying apparatus of claim 1 wherein the interconnectable parts of the canister include:

(a) a lid which has a depending, circumferentially extending skirt having threads formed on the exterior of the skirt;

(b) an upwardly opening, can-like body which has a rim near its upper end, and threads formed on the interior of the body in the vicinity of the rim, which threads are configured to matingly receive the threads which are formed on the exterior of the skirt; and, (c) said threads on the lid skirt and on the body comprising said means for releasably maintaining the first and second mating surface formations in mating engagement.

3. The spraying apparatus of claim 2 wherein:

(a) the container is formed from a relatively flexible material;

(b) at least portions of the canister means are formed from relatively rigid material; and, (c) the container has exterior wall surfaces which are configured to be closely received within rigid portions of the canister means whereby portions of the walls of the container are effectively reinforced by the canister.

4. The spraying apparatus of claim 1 wherein the outlet means includes:

(a) elongate tubular means defining a tubular passage extending from a lower portion of the interior of the container into an upper portion thereof, the tubular means having at least one liquid entry opening communicating the tubular passage with the lower portion for admitting liquid from the lower portion into the tubular passage, and having at least one gas entry opening communicating the tubular passage with the upper portion for admitting gas from the upper portion into the tubular passage; and, (b) passage defining means cooperating with the tubular means for defining a common path of flow for liquid admitted to the tubular passage through the liquid entry opening, and for gas admitted to the tubular passage through the gas entry opening, the common flow path extending from the location of the gas entry to the spray nozzle.

5. The spraying apparatus of claim 1 wherein:

(a) the first surface formation includes a substantially flat, downwardly facing surface formation on said interior surface of said one of the canister parts;

(b) the mating surface formation includes a substantially flat, upwardly facing surface formation on the access means of the container; and, (c) the means for releasably maintaining the first and mating surface formations in mating engagement includes threaded formation means provided on the canister parts for threading the canister parts together and for bringing both of the flat surface formations into snug engagement with each other to establish a liquid-tight seal therebetween.

6. The spraying apparatus of claim 1 wherein the first and mating surface formations carried on said one of the canister parts and on the access means of the container, and said means for releasably retaining the first and mating surface formations in mating engagement includes threaded formation means provided on the canister parts for threading the canister parts together to bring said other of the canister parts into engagement with the container.

7. A spraying apparatus, comprising:

(a) a bottle-like container for holding a quantity of sprayable liquid in the interior of the container, the container having a bottom wall portion, upstanding sidewall portions and a neck, and having access means in the form of a relatively wide-mouth opening defined atop the neck through which sprayable liquid may be withdrawn from the container;

(b) an upwardly opening canister body defining an upwardly opening chamber for receiving the upwardly opening container in the chamber and for closely surrounding at least the sidewall portions of the container when the container is positioned in the chamber;

(c) closure means removably secured to the canister body for closing the upwardly opening chamber and for closing the upwardly opening container;

(d) inlet means for communicating an upper region of the container with a source of pressurized gas, the inlet means including an inlet passage formed through the closure means for admitting pressurized gas through the opening and into the container;

(e) a spray nozzle; (f) outlet means for ducting liquid from a lower region of the interior of the container to the nozzle;

(g) a formations means including:

(i) a flat, downwardly facing surface formation on an interior surface of the closure means; and, (ii) a flat, upwardly facing surface formation of the container; and, (h) clamping means for bringing both of the flat surface formations into snug engagement to establish a liquid-tight seal therebetween.

8. The spraying apparatus of claim 7 wherein the outlet means further comprises means for concurrently ducting liquid from a lower region of the container and pressurized gas from an upper region of the container along a common path of flow for discharge through the nozzle as a spray, with the outlet means including:

(a) an outlet passage formed through the closure means;

(b) a tubular structure carried by the closure means and depending therefrom through the upper region of the container into the lower region of the container and defining a tubular passage which extends from the lower region through the upper region and into communication with the outlet passage;

(c) at least one liquid entry opening formed in the tubular structure communicating the lower region with the tubular passage for admitting liquid from the lower region into the tubular passage;

(d) at least one gas entry opening formed in the tubular structure communicating the upper region with the tubular passage for admitting pressurized gas from the upper region into the tubular passage;

(e) the outlet passage and the tubular passage cooperating to define a common path of flow for liquid and gas admitted to the tubular passage from the upper and lower regions, the common flow path extending from the location of the gas entry opening to the nozzle; and, (f) the size of the gas entry opening being selected to control the relative quantities of gas and liquid which flow along the common flow path, whereby the rate at which liquid discharges through the nozzle is likewise controlled by the size of the gas entry opening.

9. The apparatus of claim 8 wherein:

(a) the closure means has a bottom surface and an upwardly-extending bore which defines at least a portion of the outlet passage;

(b) the upwardly-extending bore opens through the bottom surface of the closure means; and, (c) the gas entry opening is located in the interior of the container when the container is positioned in the chamber, and in relatively close proximity to said bottom surface.

10. The spraying apparatus of claim 7 wherein the clamping means includes mating threaded formations carried on the canister body and on the closure means.

11. The spraying apparatus of claim 7 wherein:

(a) the closure means has a depending, circumferentially extending skirt having threads formed on the exterior of the skirt; and, (b) the canister body has a rim near its upper end, and threads formed on the interior of the body in the vicinity of the rim, which threads are configured to matingly receive the threads formed on the interior of the skirt of the lid.

12. The spraying apparatus of claim 7 wherein:

(a) the container is formed from a relatively flexible material;

(b) at least portions of the canister means are formed from relatively rigid material; and, (c) the container has exterior wall surfaces which are configured to be closely received within rigid portions of the whereby portions of the walls of the container are effectively reinforced rigid portions of by the canister.

* * * * *